United States Patent [19]

Hechler et al.

[11] Patent Number: 4,662,620

[45] Date of Patent: May 5, 1987

[54] FOLDED PRODUCTS TRANSPORT APPARATUS

[75] Inventors: Hatto Hechler, Ostfildern-Rhuit; Albert Mayer, Augsburg, both of Fed. Rep. of Germany

[73] Assignee: M.A.N.-ROLAND Druckmaschinen Aktiengesellschaft, Offenbach am Main, Fed. Rep. of Germany

[21] Appl. No.: 826,559

[22] Filed: Feb. 6, 1986

[30] Foreign Application Priority Data

Feb. 7, 1985 [DE] Fed. Rep. of Germany ..... 3504085

[51] Int. Cl.[4] ..... B65H 5/30

[52] U.S. Cl. ..... 270/55; 198/644; 198/679; 198/680; 271/901

[58] Field of Search ..... 270/54–55, 270/57–58; 198/644, 679, 680; 271/901

[56] References Cited

U.S. PATENT DOCUMENTS

| | | | |
|---|---|---|---|
| 2,526,253 | 10/1950 | Merrill | 198/679 |
| 2,726,752 | 12/1955 | Maher | 271/901 |
| 4,036,356 | 7/1977 | Reist | 198/280 |
| 4,051,946 | 10/1977 | Buccicone | 198/679 |
| 4,471,953 | 9/1984 | Reist et al. | 270/54 |
| 4,484,733 | 11/1984 | Loos et al. | 270/54 |
| 4,489,930 | 12/1984 | Meier | 270/55 |
| 4,602,774 | 7/1986 | Kobler | 270/54 |
| 4,605,212 | 8/1986 | Kobler | 270/54 |
| 4,605,213 | 8/1986 | Hechler | 270/55 |

*Primary Examiner*—E. H. Eickholt

*Attorney, Agent, or Firm*—Frishauf, Holtz, Goodman & Woodward

[57] ABSTRACT

To provide for transfer of folded products, such as folded printed sheets received from a printing machine, between storage bins and a conveyor transport system, transport sheets which, at least in part, are magnetizable, are retained in the storage bins; a transfer element (9) in form of an endless elongated belt or the like has electromagnets secured thereto which are selectively energized to pick up the transfer sheets. The transfer element or belt is guided in a path past a delivery end (7'') of a storage holder, then into the path of the transport system (2, 3) for transfer of folded products (1) from or to the sheets, and return of the sheets to a receiving end of the storage bin, at which point the magnets are deenergized to release the sheets into the bin, and can continue to travel—while deenergized—in an endless path for subsequent pick-up of sheets.

13 Claims, 3 Drawing Figures

FOLDED PRODUCTS TRANSPORT APPARATUS

Reference to related publications, assigned to the assignee of the present invention:

U.S. Ser. No. 756,779, filed July 18, 1985, Hechler, U.S. Pat. No. 4,605,213

U.S. Ser. No. 757,005, filed July 19, 1985, Kobler, U.S. Pat. No. 4,605,212

U.S. Ser. No. 761,048, filed July 31, 1985, Kobler, U.S. Pat. No. 4,602,774

The present invention relates to material handling, and more particularly to transfer apparatus to transfer folded products, such as folded sheets, folded printed goods and the like, between a transport mechanism and storage devices or storage bins.

BACKGROUND

Transport devices to transport folded products by engaging a transport rod or the like within the pleat or fold of the folded product, hanging the folded product from the rod, and transporting the rod are well known. The referenced patent applications describe transport arrangements of this type. Another transport apparatus is described in German Patent Publication Document DE-OS No. 34 27 558, in which folded products are guided by a transportor device including guide elements or guide rods which are introduced from both sides into the fold of the folded products. The folded products, typically, are groups of paper sheets derived, for example, from a printing machine.

In various arrangements it is desirable to store the folded products, in folded condition, for example in storage bins.

THE INVENTION

It is an object to provide an apparatus which permits transfer of folded products, hanging from a hanger introduced into the fold or pleat thereof, between a transport apparatus and a storage element or bin, such that the folded products will continue to be supported at the inner side of the pleat or fold.

Briefly, a transport system is provided including hangers having transversely extending hanger rods on which the folded products are adapted to hang. The folded products are to be transferred between the transport system and storage holders or bins. A plurality of sheet-like transport elements which, at least in part, include magnetically attractable material, typically ferrous metal sheets, are provided, located in the storage holders. Transfer elements, for example in the form of endless belts, are guided in a path adjacent a delivery end of the storage bins. The transfer elements have electromagnets secured thereon which, for example by contact with a bus bar, trolley wire or the like, are selectively energized so that, as the electromagnets pass the metal sheets, the metal sheets are picked up. The transfer elements are guided in a path adjacent and past the delivery end of the holding bin, and then adjacent and past the receiving end of the holding bin. Intermediate the delivery and receiving end, the sheets are guided by the transfer elements towards the transport system of the folded products, either to deliver sheets on which folded products previously had been placed, and picked up from the holding pin, or to introduce the sheets within the fold of the folded products, for pick-up from the transport system and subsequent delivery to the holding bins. The electromagnets are selectively energized for pick-up and release of the metal sheets at the appropriate delivery and/or receiving position of the bins.

DRAWINGS

FIG. 1, schematically, is a side view of a device to receive folded products from a transport system and to store the folded products in receiving bins; the same system can also be used to load the transport system from a storage bin which previously had been filled with folded products, folded over a deliver sheet;

FIG. 2 is a fragmentary side view of a magnetizable folded product transport element in sheet form; and FIG. 3 is a schematic side view of the system to transfer folded products from a storage bin to a transport system including transport hangers.

DETAILED DESCRIPTION

Figures 1, 2:
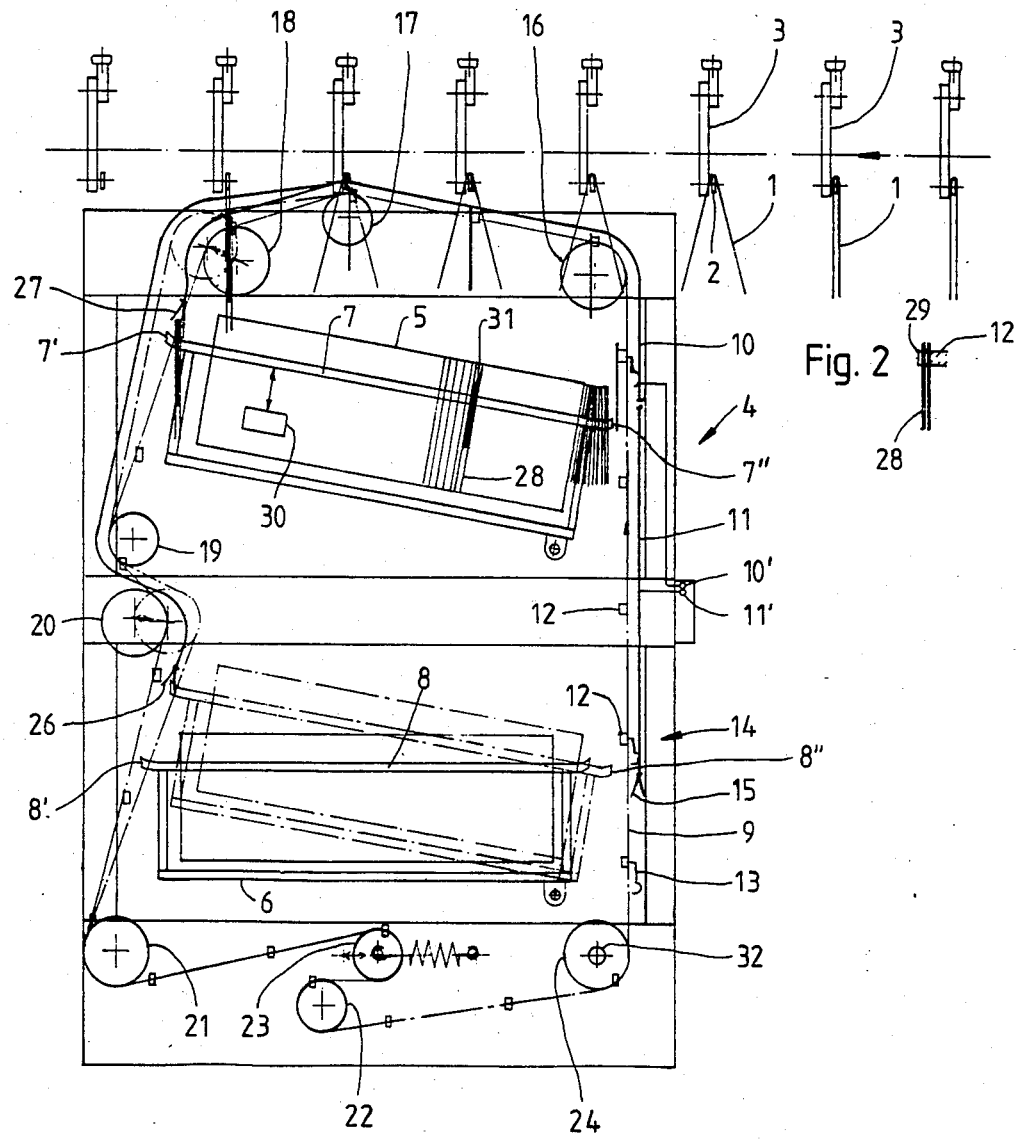

Referring first to FIG. 1 which, generally, shows the arrangement to transfer folded products from a transport system for storage in a storage bin.

The folded products 1 are suspended on holder rods 2, slipped within the fold or pleat of the folded products 1. The rods 2 are held on hangers of a transport chain, belt or the like, shown only schematically by the chain-dotted line, and moving from right to left in FIG. 1. The hangers, preferably, are located on both end portions of the rods 2. The transport system may include an endless chain, belt or the like.

In accordance with the invention, a transfer apparatus 4 is provided, located adjacent the transport system including the hangers 3. The apparatus 4 receives and stores the folded products 1, transferred thereto by the hanger rods 2 on the haugers 3. The apparatus 4 includes a storage holder 5, in form of a bin, in which the folded products 1, delivered from the transport system 2, 3 are to be stored. In accordance with a preferred feature of the invention, more than one storage bin is provided, and, for simplicity of illustration, only a second single bin 6 is shown. Providing more than one bin permits continuous, uninterrupted operation, by changing over between the bins as they are being filled, for example by changing over for storage of folded products in bin 6 when bin 5 is full or about full. The bins 5, 6 are movably supported, for example on wheels or the like, and can be removed from the station 4, for example by a fork lift truck, or the like.

The respective bins 5, 6 are formed with holding means 7, 8 which, as shown, are inclined when located in working position. A plurality of parallel, adjacently located holding elements 7, 8 can be provided; they may be in form of rods, rails, or the like.

The holding elements 7 have, respectively, a receiving end 7' and a delivery end 7''. In accordance with a feature of the invention, a circulating, endless transfer element 9 in form of a belt or chain is guided to pass along the ends 7, 7' of the holding rods or rails 7. A portion of the path of the transfer element 9 has a two-part electrical elongated conductor, for example in form of a bus bar 10, 11, associated therewith. The bus bars are, respectively, energized by terminals 10', 11', at suitable instants, or time durations, to permit energization of electromagnets 12 secured to the transfer element 9. The electromagnets 12 are located, longitudinally staggered, on the transfer element, belt or chain 9; they have a slider or pick-up contact 13 secured thereto which, as illustrated at 14, can be tipped or pivoted into electrical contact engagement with one, or the other, or both, of the electrical lines 10, 11. A receiving funnel 15 is particularly suitable, located just shortly in advance of the holding rods 8 of the bin 6. Resetting of the slider or pick-up terminal 13, and thus separation from electrical energization potential of the respective magnets 12, is done by oppositely directed funnels or pivoting elements 26, 27, located close to the respective receiving ends 7', 8' of the holders 7, 8 respectively. The arrangement insures that the electromagnets 12, thus, can be energized shortly before reaching the respective delivery ends 8", 7" and are deenergized shortly before reaching the receiving end 7', 8', respectively, energization being effected under control of energization of terminals 10', 11' in dependence upon which one of the bins 5 or 6, with the holders 7 or 8, is to receive folded sheets from the transport system 2, 3.

The transfer belt, chain or, generally, transfer element 9, is guided in its path by guide rollers 16, 17, 18, 19, 20, 21, 22,23, 24, the path being shown in FIG. 1. One of the rollers, for example roller 24, is driven by a suitable motor drive, schematically shown by motor 32. Roller 23 is a tension roller for the transfer element 9. Separate control terminals 10', 11' are connected to the respective bus bars 10, 11.

In accordance with a feature of the invention, the folded product transport elements are flat metal sheets, made of a material which can be magnetized, that is, can be picked up by magnetic force by the electromagnets 12; alternatively, sheets of other materials may be used, provided sufficient magnetic material is embedded therein, or forms part thereof, to permit such holding and pick-up by the electromagnets 12. The sheets 28 need not be entirely of magnetic material. It is sufficient if predetermined regions of the transport elements 28 are magnetizable, the regions being so located that they can be brought into opposition to the magnets 12, for pick-up thereby.

The holders 7 of the bin 5 and the holders 8 of the bin are provided to introduce and hold the transport sheets 28, adjacently positioned. The transport sheets are introduced in the receiving ends 7', 8', respectively, in such a manner that, for example by inclination of the holders 7 and 8, the sheets 28 slide, by gravity, from left towards the right (in FIG. 1), that is, towards the delivery ends 7", 8" of the bins 5, 6. The transport sheets 28 are close together when positioned on the holders 7 and 8. To provide for reliable pick-up of only one transport sheet, non-magnetic spacers 29 (FIG. 2) are provided, for example secured to a suitable zone on the transport sheets 28 to provide for effective separation of adjacent sheets with respect to the pick-up force exerted by the magnets 12. To insure downward sliding of the sheets 28, without undue inclination, a vibrator apparatus 30 is coupled to the holder rods or rails 7. When a non-magnetic part, for example in form of a non-magnetic plate 31, reaches the delivery end 7" of bin 5, an indication is provided that the respective bin 5, or 6, is full. No transport sheet 28 will be left to be transferred from the respective ends 7", 8" to a magnet 12. As shown in FIG. 1, the electromagnets can pick up transport sheets 28 from either one of the bins 5 or 6, and, in an upward movement, introduce the sheets beneath and within the folded products 1. The folded products 1 can be carried ordinarily folded flat towards each other; if the rod 2 is rectangular in cross section, rotation of the rod 2 in advance of reaching the station 4 will tend to spread the folded products, as shown in FIG. 1, to permit introduction of the sheets 28 into the spread-apart portions of the product 1. The holder rods 2 are pulled out laterally, transverse to the plan of the drawing of FIG. 1, to permit transfer of the folded product to the sheet 28. Any suitable arrangement may be used, for example by pulling the rods 2 laterally, guiding the transport system in a path obliquely or upwardly with respect to the unit 4, or the like.

OPERATION

Transport sheets 28, located for example on the holder rods 7 on bin 5, are picked up by the respective magnets 12, moving upwardly on the transport elements 9. The sheets 28, being guided in a path determined by the guide pulleys or rollers 16, 17 are introduced within the opened folded elements, the holder for the folded elements 2 is withdrawn, or the path of the holders changed, for example at the position of the guide rollers 17. The folded products are then guided in a path determined by the location of the roller 18 to the receiving end 7' of the bin 5 or, respectively, to the receiving end 8' of the bin 6, depending upon which one of the bins is to be filled. Let it be assumed that, first, the bin 5 is to be filled. Guide roller 18 is moved in the position in full line in FIG. 1; at that point, the magnets which pass the deenergization switch funnel 27 will be deenergized, so that the transport sheet 28, with the folded product hanging thereon, will drop on the holding rods or bars 7. Preferably, and in order to insure reliable pick-up, the ends of the holding element 7 are bent upwardly, as shown at 7' and 7". Similarly, the holding rods or elements 8 are bent as seen at 8', 8".

To load the upper bin 5, it is necessary to move the guide roller 20 away from the bin 6, that is, to move the guide roller 20 into the full-line position as shown.

If the bin 6 is to be loaded, the guide rollers 18, 20 are moved into the position shown in chain-dotted lines which, in turn, will change the path of the transfer element 9 from full-line position to the chain-dotted position. The transport sheets 28 then will pass by the receiving end 7' of the bin 5, and will not be deenergized until they reach the second deenergization switch or funnel 26, to leave the transfer element 9 at the bin 6 and to be stored therein. Thus, by deenergization of the magnets 12 adjacent the bin 6, the transport sheets 28 and the folded products 1 hanging thereon will be stored in the bin 6.

The respective conductors 10, 11 are suitably energized to determine initiation of energization of the magnets 12 so tha again in dependence on from where the sheets are to be picked up, that is, bins 5 or 6, the respective transport sheets 28 can be moved by the transfer element 9 away from the respective bin and the respective holders 7, 8.

Figure 3:
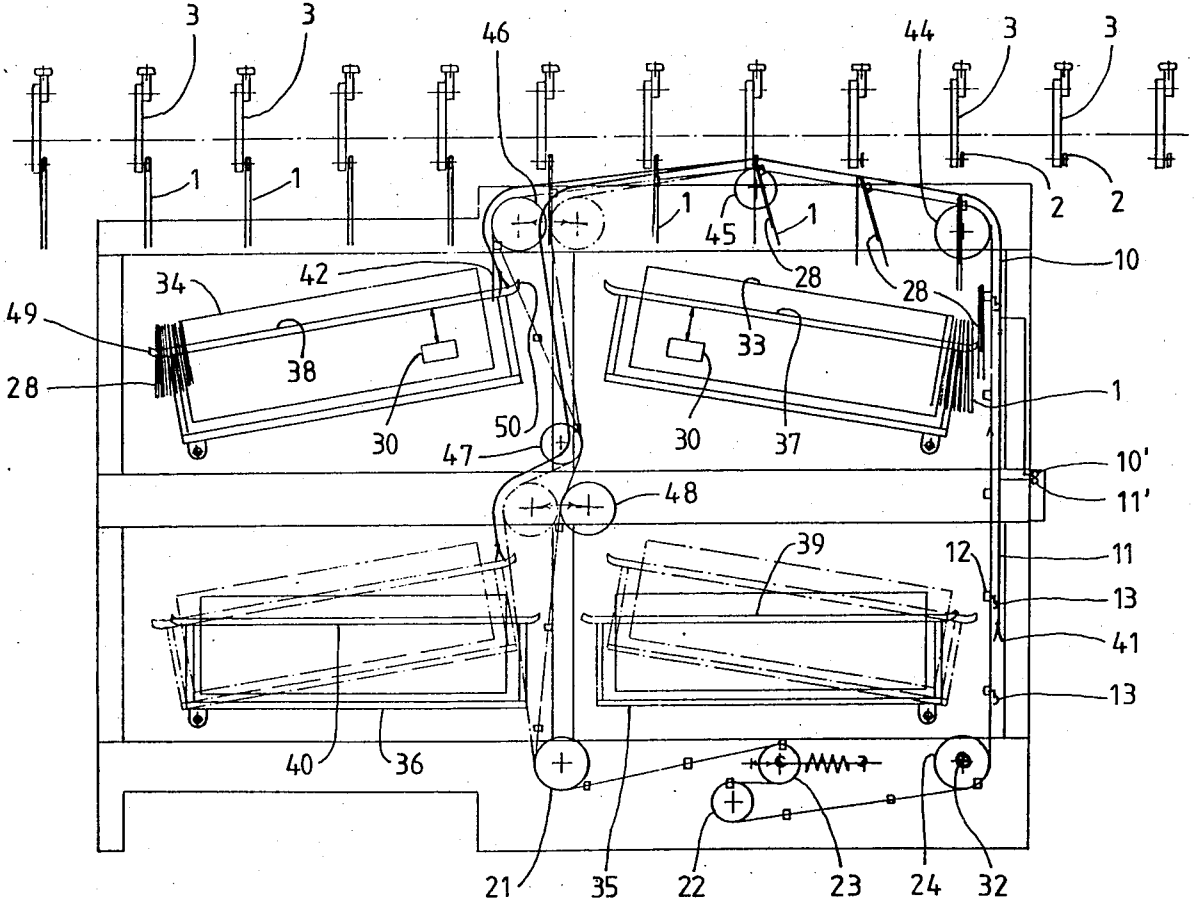

FIG. 3 illustrates an arrangement of a combination loading, unloading station which, basically, is similar to the structure described in connection with FIG. 1. Identical or similar, or similarly operating parts have received the same reference numerals as in FIG. 1.

The structure of FIG. 3 permits storage or reception of folded products taken off the transport system 2, 3 or, alternatively, loading of the transport system 2, 3 with folded products hanging on sheets 28 in respective bins.

FIG. 3 illustrates four bins 33, 34, 35, 36, each having its own holding elements 37, 38, 39, 40. Folded products which are retained, for example, in the bins 33, 35, are transferred to transport system 2, 3. In this arrangement, the operating mode is reversed with respect to that of FIG. 1. The magnetic arrangement in accordance with the present invention permits this reversible effect, that is, loading of the transport system, or unloading from the transport system, that is, free transfer of the sheets 1 between the storage bins and the transfer system in either direction. The use of the system as a loading station is readily possible, it is merely necessary to suitably tilt the respective bins and to provide for an arrangement to spread apart the folded products to permit introduction of the hangers 2 from the system 2, 3 thereinto. This can be easily obtained by tilting or inclining the sheets 28, to provide for the spreading effect—see FIG. 3—specifically the sheet 28 between the guide rollers 44, 45.

After transfer of the folded products 1 from a bin 33, or, for example, when the bin is empty, from another bin such as bin 35, to the transport system 2, 3, which moves from right to left in FIG. 3, empty transport sheets 28 are collected for re-use, using the bins 34, 36. When the bin 33 is empty, the transport sheets are transported to the bin 34; when the bin 35 is empty, the empty sheets are transported to the bin 36.

As described in connection with FIG. 1, each of the bins 33–36 has one or more holder rods or bars or rails 37–40, which are inclined. To empty one of the bins, the electromagnets 12 are suitably energized, for example by energization of the control terminal 10' with voltage when a magnet passes the bin 33, picking up a transport sheet 28 with a folded product 1 hanging thereon. The transfer element 9 moves the folded product 1, together with the sheet 28 therein upwardly, towards the rods 2 of the system 2, 3. The sheet 28 is inclined, resulting in spreading of the folded product, so that the transport rods 2 can readily be inserted from the side within the fold or pleat of the folded products 1. The transport sheets 28 are then further guided by the transfer element 9 until the magnets are deenergized at the deenergization switch or funnel 42, for storage of the sheets in the bin 34.

If it is desired to place sheets from the bin 35 on the transport system 2, 3, the magnets 12 are energized already when they reach the funnel 41, using, for example, line 11, by energization of the terminal 11' thereon. Transfer of the folded products 1 to the transport rods 2 will be as previously described the transport sheets 28 are then returned to the bin 36 by deenergizing the magnets 12 when they reach the switch or funnel 43.

The desired path for the transfer element 9 is obtained by suitable placement of the guide rollers or pulleys 44, 45, 46, 47, 48. Depending on the bin to be used, that is, bins 33 and 34 or 35 and 36, respectively, guide rollers 46 and 48 are placed in, respectively, full-line or broken-line position—the full-line position conforming to use with bins 33, 34. As shown at 49, 50, the ends of the holders 37 to 39 are bent upwardly.

Various changes and modifications may be made, and features described in connection with any one of the embodiments may be used with any of the others, within the scope of the inventive concept.

We claim:

1. Folded products transfer apparatus for transferring folded products (1) between a storage holder (5, 6; 33, 34, 35, 36) and a transport system (2, 3), wherein the transport system includes a hanger system (2, 3) having transversely extending hanger elements (2) over which the folded products (1) are folded, with the folding pleat supported from below by the hanger elements (2), said transfer apparatus comprising, in accordance with the invention, a plurality of sheet-like transport elements, defining transport sheets (28) which, at least in part, include magnetically attractable material;

holding means (7, 8; 37, 38, 39, 40) shaped to receive a group of transport sheets (28) and provide for progressive movement of the transport sheets along the length thereof from a receiving end (7', 8') to a delivery end (7'', 8'');

an elongated movable transfer element (9);

guide means (16–24) guiding said movable transfer element in a path (a) adjacent and past the delivery end (7'', 8'') of the holding means, (b) adjacent and past the receiving end (7', 8') of the holding means;

a plurality of electromagnets (12) secured to the transfer element (9) in longitudinally staggered position;

energizing means (10, 11; 13) selectively contacting the electromagnets for selective energization and deenergization thereof as the magnets pass adjacent the delivery end (7'') and the receiving end (7') of the holding means;

said guide means (16–24) further guiding the transfer element (9) in a path (c) beneath and into the folded products for transfer of folded products between said hanger elements and said transport sheets (28);

and means (10', 11') for selectively applying electrical power to the electromagnets via said energization means for (1) in a sheet pick-up mode, to provide for pick-up of transport sheets (28) from the holding means by magnetic attraction, transport of the transport sheets by the transfer element (9) to the hanger system and transfer of a folded product (1) from the hanger element to the transport sheet (28) and subsequent delivery of the folded product, on the transport sheet, to the holding means; and (2) in sheet delivery mode, to provide for pick-up of a folded product (1) on a transport element (28) from the holding means by an electromagnet, transport by the transfer element (9) to the hanger system (2, 3) and transfer of the folded product (1) from the transport sheet (28) to a hanger element (2), and subsequent delivery of the then empty transport sheet (28) back to the holding means.

2. Apparatus according to claim 1, further including non-magnetic spacer elements (29) secured to the transport sheets.

3. Apparatus according to claim 1, wherein the storage holder and the holding means are positioned at an inclination.

4. Apparatus according to claim 3, further comprising a vibrator (30) connected in vibrating operative relationship to the holding means to provide for movement, by gravity, of the transport sheets to the lowermost position of the storage holder, said lowermost position forming the delivery end (7'', 8'').

5. Apparatus according to claim 1, wherein the energizing means comprise elongated electrical connecting lines (10, 11) extending essentially parallel to said paths (a, b, c) for energizing the magnets (12).

6. Appratus according to claim 5, wherein the magnets include a slide or pick-up shoe connection (13) with the elongated electrical connecting lines (10, 11); and contacting engagement control means (15, 27) associated with the electrical connecting lines and controlling timed engagement of the slide or pick-up shoe connections with the electrical connection lines.

7. Apparatus according to claim 1, wherein at least two storage holders (5, 6; 33, 34, 35, 36) are provided, each storage holder having an associated holding means (7, 8; 37, 38, 39, 40); and wherein the transfer element (9) is guided in said paths past the receiving ends (7′, 8′) and the delivery ends (7″, 8″) of respective ones of said storage holders for successive pick-up of transport sheets from respective delivery ends and delivery of transport sheets to respective receiving ends for transfer of the folded products to, or from the transport system from or to said transport sheets.

8. Apparatus according to claim 7, wherein at least one of the guide means (18) comprises a movably secured roller (18), movable to change the path of the transfer element immediately adjacent the delivery end (7″, 8″) of a respective one of the holding means, while being spaced from the delivery end (8″, 7″) of another one of said holding means; and a further movable guide roller (20) selectively positionable to guide the transfer element in a path immediately adjacent the receiving end (7) of one of said holding means and spaced from the receiving end of another one of said holding means, for selective pick-up and delivery of the transport sheets to selected ones of said storage holders in accordance with the position of the respective rollers.

9. Apparatus according to claim 7, wherein the energizing means comprises at least two electrical elongated conductors (10, 11), and wherein one of the electrical conductors is associated with one storage holder, and another electrical conductor with another storage holder.

10. Apparatus according to claim 1, wherein the storage holders are individually removable from the apparatus.

11. Apparatus according to claim 1, wherein the transport sheets are sheet-metal elements.

12. Apparatus according to claim 1, wherein the transfer element comprises an endless conveyor belt or chain, on which the electromagnets are retained, in longitudinally staggered position.

13. Apparatus according to claim 1, including drive means (32) driving said transfer element (9) to move in said paths.

* * * * *